US005366232A

United States Patent [19]

Pozzobon et al.

[11] Patent Number: 5,366,232

[45] Date of Patent: Nov. 22, 1994

[54] ADJUSTMENT DEVICE FOR SPORTS IMPLEMENTS

[75] Inventors: Alessandro Pozzobon, Paderno Di Ponzano Veneto; Mariano Sartor, Montebelluna, both of Italy

[73] Assignee: Nordica S.p.A, Trevignano, Italy

[21] Appl. No.: 917,094

[22] PCT Filed: Dec. 6, 1991

[86] PCT No.: PCT/EP91/02343

§ 371 Date: Aug. 4, 1992

§ 102(e) Date: Aug. 4, 1992

[87] PCT Pub. No.: WO92/10251

PCT Pub. Date: Jun. 25, 1992

[30] Foreign Application Priority Data

Dec. 10, 1990 [IT] Italy ..... 28992 B/90
Dec. 10, 1990 [IT] Italy ..... 40162 A/90
Dec. 10, 1990 [IT] Italy ..... 40163 A/90

[51] Int. Cl.[5] ..... A63C 17/04

[52] U.S. Cl. ..... 280/11.22; 280/11.27; 280/43; 280/43.16

[58] Field of Search ..... 280/11.19, 11.22, 11.23, 280/11.26, 11.27, 11.28, 43, 43.13, 43.16, 43.17, 43.22, 43.18

[56] References Cited

U.S. PATENT DOCUMENTS 2,254,450 9/1941 Ronish ..... 280/11.27
5,046,746 10/1991 Gierveld ..... 280/11.27
5,068,956 12/1991 Malewicz ..... 280/11.27

*Primary Examiner*—Richard M. Camby
*Attorney, Agent, or Firm*—Guido Modiano; Albert Josif; Daniel O'Byrne

[57] ABSTRACT

An adjustment device for a roller skate including a support for an item of footwear and at least two aligned wheels. The device has the peculiarity of having, between the at least two aligned wheels, a screw for adjusting the interspace therebetween, as well as kinematic systems for interconnection with the support. The device allows to vary the distance between the support for the item of footwear and the axle of one or more of the aligned wheels of the skate.

8 Claims, 5 Drawing Sheets

ADJUSTMENT DEVICE FOR SPORTS IMPLEMENTS

BACKGROUND OF THE INVENTION

The present invention relates to an adjustment device for sports implements, particularly for a skate comprising a plurality of aligned wheels.

Skates which have mutually aligned wheels are currently known; their use is aimed, to an increasingly specific extent, to the sports practice of speed skating or slalom.

These two different specialties require the wheels of the skate to have different arrangements with respect to the support for the item of footwear: slalom in fact requires a configuration which allows to achieve a very tight radius of curvature, whereas speed skating requires a configuration which allows to achieve the straightest possible driving.

Skates are thus known which have aligned wheels wherein the variation of the position of said wheels is achieved by virtue of the interaction of the ends of the pivot of each wheel with a separate eccentric element.

The disadvantage which can be observed in these known types of device consists of the fact that the partial disassembly of the assembly constituted by the wheel and by the pivot is required in order to then be able to rotate the eccentric through 180° in order to achieve a different arrangement of the axle of the wheel with respect to the support of the wheel or to the ground.

This all leads, therefore, to a scarce functionality and practicality of said known devices, which force the user to perform long interventions which require the use of special tools.

It is furthermore possible to achieve only two different positions which are due to the two positions which the eccentric element can assume.

SUMMARY OF THE INVENTION

The aim of the present invention is therefore to eliminate the disadvantages described above in known types by providing a skate with aligned wheels in which it is possible to rapidly and easily adjust the distance between the support for an item of footwear and the axle of one or more of the aligned wheels.

A further aim of the present invention is to provide a skate with aligned wheels wherein it is possible to rapidly and easily adjust the distance between the sole of an item of footwear and the axle of one or more of the aligned wheels.

Within the scope of this aim, an important object is to provide a device wherein the user can perform said adjustments without having to have particular tools available.

Another object is to provide a device which allows to achieve a continuous and not discrete adjustment.

Another important object is to provide a device which is structurally simple and wherein it is not necessary to disassemble the various components in order to achieve said adjustment.

Not least object is to provide a device which associates with the preceding characteristics that of being reliable and safe in use.

This aim, these objects and others which will become apparent hereinafter are achieved by an adjustment device for sports implements, particularly for a skate comprising a support for an item of footwear and at least two aligned wheels each having a shaft, characterized in that adjustment means are provided between said at least two aligned wheels and are suitable for simultaneously varying the interspace between said wheels and the distance between said support and the shaft of said at least two aligned wheels.

BRIEF DESCRIPTION OF THE DRAWINGS

Further characteristics and advantages of the invention will become apparent from the detailed description of a preferred but not exclusive embodiment, illustrated only by way of non-limitative example in the accompanying drawings, wherein.

DESCRIPTION OF THE PREFERRED EMBODIMENTS

Figure 1:
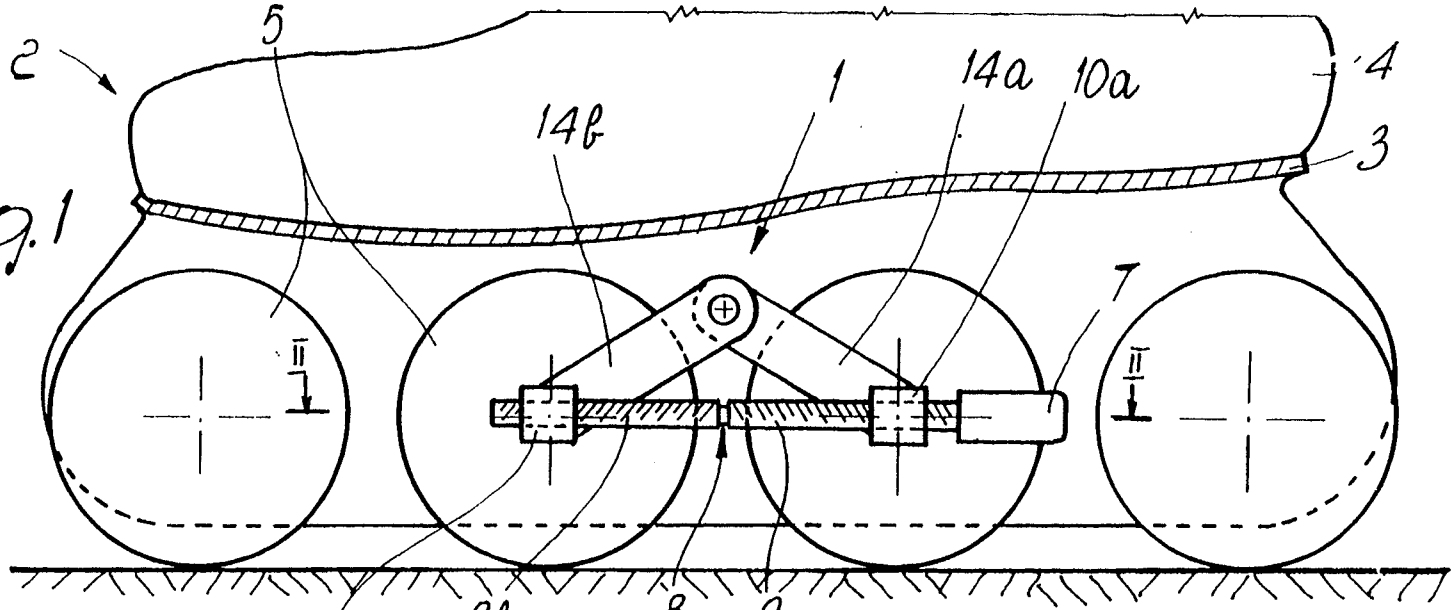
FIG. 1 is a partially sectional side view of a skate according to the invention with the wheels arranged in the condition of minimum extension with respect to the frame.
Figure 2:
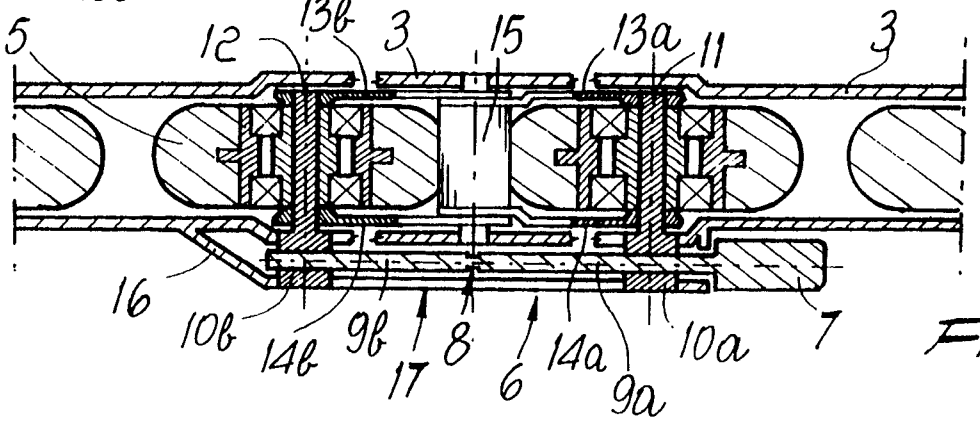
FIG. 2 is a partially sectional top view of the skate according to the line II—II of FIG. 1.

With reference to the above figures, the reference numeral 1 indicates an adjustment device for sports implements, particularly for a skate 2 which comprises a support 3 for an item of footwear 4 which also constitutes a frame for one or more mutually aligned wheels 5.

The adjustment device 1 is interposed between two or more of said wheels 5 which are mutually adjacent, and comprises a means for adjusting both the interspace between said wheels and the distance between the support 3 and the axle of said adjacent wheels 5.

Said adjustment device is constituted by a screw 6 which is provided with a head 7 which can be accessed by the user and with a stem 8 which has two distinct regions, 9*a*, and 9*b*, with opposite threads.

Said two distinct regions interact with a first sleeve and with a second sleeve which are complementarily threaded and are indicated by the numerals 10*a* and 10*b*; each sleeve is rigidly associated with the concordantly orientated end of one of the two pivots, or shafts, 11 and 12 of the two adjacent wheels being considered.

Kinematic systems for interconnection between two of said mutually adjacent wheels and said support also constitute the adjustment device: said systems are constituted by a first pair of connecting rods and by a second pair of connecting rods, indicated by the numerals 13*a*, 13*b* and 14*a*, 14*b*, which are freely pivoted to one another at one end at a third sleeve 15 and are pivoted to the pivots, or shafts, 11 and 12 at the other end.

Said third sleeve 15 is in turn pivoted to the support 3 at its ends.

Advantageously, a wall 16 is arranged laterally to the support 3, and a guiding slot 17 is defined in said wall for the sliding and movement of the first and second sleeves 10*a* and 10*b* during the activation of the screw 6.

The use of the adjustment device is as follows: by gripping and turning the head 7 of the screw 6, the user forces the mutual approach or spacing of the first and second sleeves 10*a* and 10*b*; due to the presence of the first and second pairs of connecting rods, which are pivoted to the third sleeve 15 which is in turn rotatably associated with the support 3, this movement is followed by a simultaneous lifting or lowering of the screw 6.

The combination of these two movements causes the lifting or lowering and, respectively, the simultaneous mutual approach or spacing of the two adjacent wheels affected by the device.

Figure 3V:
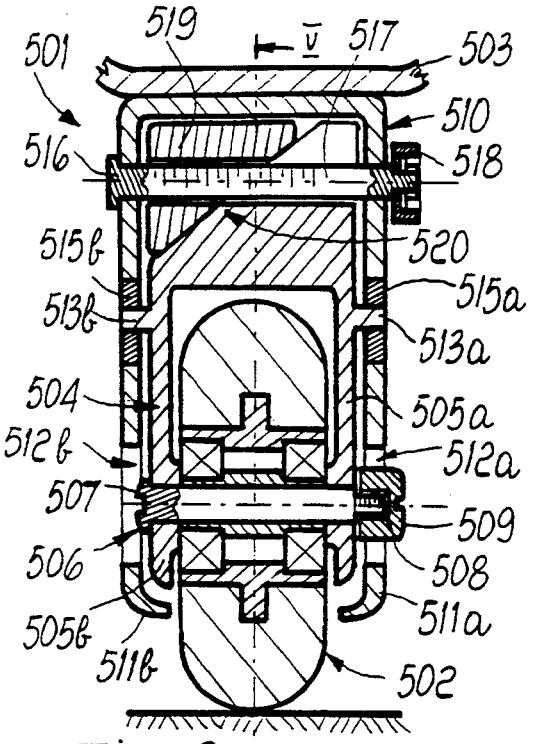
FIG. 3 is a partial sectional view, taken along a longitudinal median sectional plane, of a skate according to a further aspect of the invention with the wheel arranged in the condition of minimum extension with respect to the frame.
Figure 4:
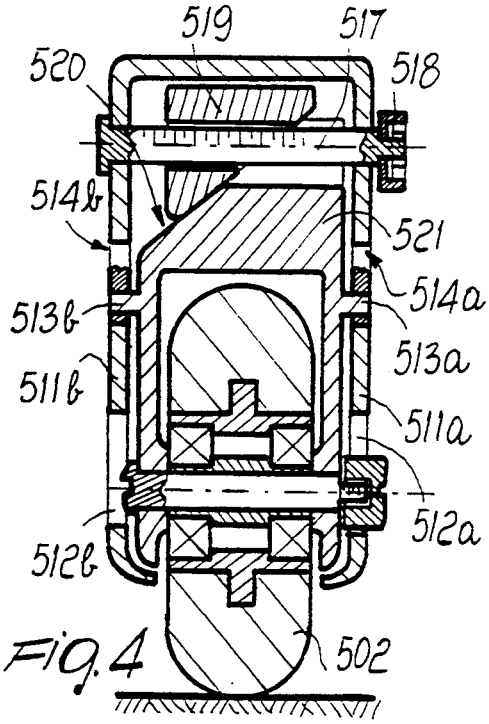
FIG. 4 is a view, similar to the preceding one, of an intermediate condition of the position of the wheel with respect to the frame.

With reference to FIGS. 3–4, the adjustment device, according to a further aspect of the invention, generally indicated by the reference numeral 501, is particularly usable for a skate which comprises two or more aligned wheels 502 and an item of footwear 503.

The adjustment device comprises a carriage 504 which has a substantially C-shaped configuration which defines first wings 505*a* and 505*b* between which at least one wheel 502 can be arranged by means of an adapted pivot 506 which has a head 507 which protrudes outside the wing 505*b* and a threaded stem 508 which protrudes outside the wing 505a, to which a complementarily threaded nut 509 can be temporarily secured.

Said carriage 504 is slidingly associable inside a C-shaped frame 510 above which the item of footwear 503 is rigidly associated.

The frame 510 has second wings 511*a* and 511*b* which are arranged parallel to the first wings 505*a* and 505*b* and are slightly longer than said first wings.

First slots 512*a* and 512*b* are furthermore defined longitudinally on the second wings 511*a* and 511*b*, and the head 507 and the nut 509 can slide freely thereat.

Means for guiding the mutual position of the carriage 504 with respect to said frame 510 are also arranged at the second wings 511*a* and 511*b* of the frame 510; said means are constituted by a pair of pivots 513*a* and 513*b* which protrude laterally outside the wings 505*a* and 505*b* of the carriage 504 and slide within adapted second slots 514*a* and 514*b* which are defined longitudinally with respect to the second wings 511*a* and 511*b*.

Resilient members, such as pads 515*a* and 515*b*, are interposed at the pivots 513*a* and 513*b* at said second slots; the function of said resilient members is to provide an elastic contrast to the movements of the carriage with respect to the frame.

Between the connecting base sides of the first and second wings of the carriage 504 and of the frame 510 there are means for adjusting the mutual position thereof; said means are constituted by a screw 516 which is freely rotatably associated transversely to the frame 510 and is provided with a threaded stem 517 and with a knob 518 which can be accessed by the user.

The threaded stem 517 interacts with a complementarily threaded seat defined on a slider 519 which has an essentially triangular cross-section; the inclined side of said slider is directed toward the underlying carriage 504 and interacts with an equally inclined plane 520 of a raised portion 521 which protrudes from said carriage 504.

The use of the device is as follows: by gripping the knob 518, the user can impart a rotation to the threaded stem 517 of the screw 516, so as to move the slider 519.

Said slider spaces or not the underlying raised portion 21 and therefore the carriage 504 from the frame 510, as can be deduced from FIG. 4.

Figure 5:
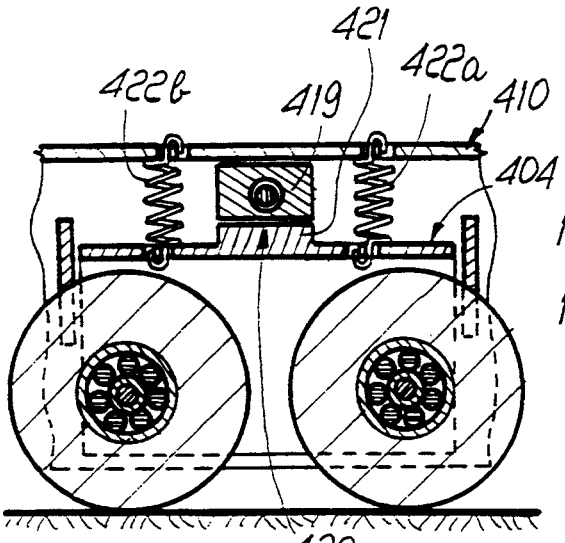
FIG. 5 is a sectional view, taken along a longitudinal sectional plane, of a third embodiment.

According to the variated embodiment of FIG. 5, the resilient members are interposed between the frame 410 and the carriage 404 and are constituted by a pair of springs 422*a* and 422*b* which are arranged in regions adjacent to the slider 419 and the raised portion 421 which is provided with the inclined plane 420.

The presence of the pair of springs 422*a* and 422*b* allows to reposition the carriage adjacent to the frame after the slider has been pushed toward the wing 11*b* of the frame.

Figure 6:
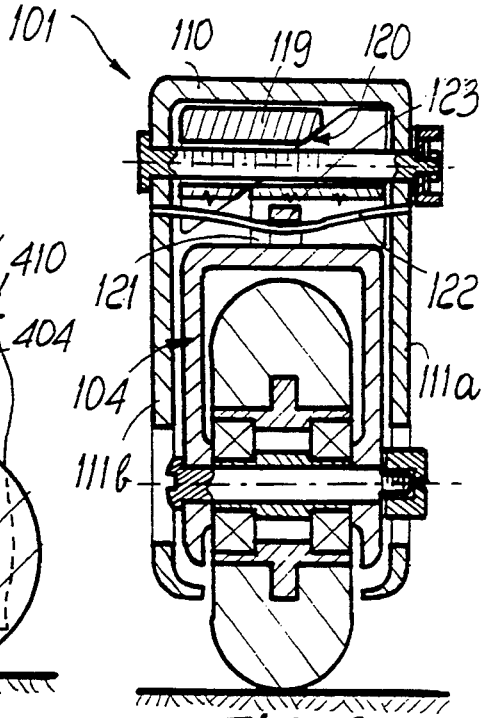
FIG. 6 is a view, similar to that of FIG. 3, of a fourth embodiment.

FIG. 6 illustrates a third embodiment, wherein the adjustment device for sports implements, generally indicated by the reference numeral 101, again has a raised portion 121 provided with an inclined plane 120 which interacts with the inclined side of the slider 119; a resilient member, constituted by one or more leaf springs 122, is interposed between the carriage 104 and the frame 110.

Said leaf spring is arranged transversely to the frame 110 in the interspace defined between said frame and the carriage 104; the ends of the leaf spring are sunk in the wings 111*a* and 111*b* of the frame 110.

The interconnection between the leaf spring 122 and the carriage 104 occurs approximately at the median region of said carriage by virtue of the presence of a hook 123 which protrudes perpendicularly and above said carriage 104.

Figure 8:
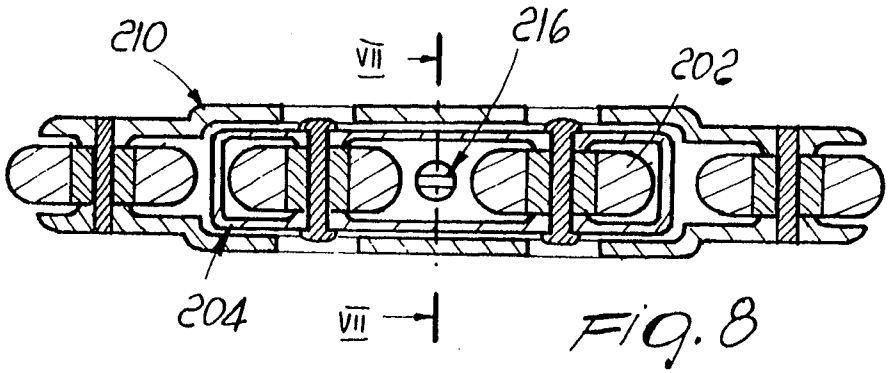
FIG. 8 is a bottom view of a skate according to the preceding figure.
Figure 7:
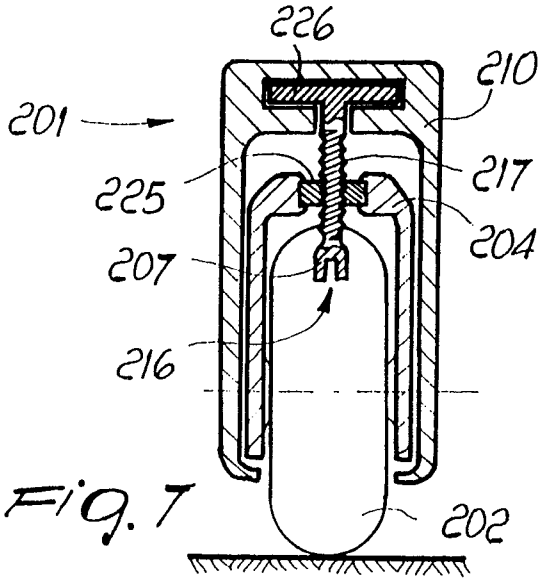
FIG. 7 is a view, similar to that of FIG. 3, of a fifth embodiment.

FIGS. 7 and 8 illustrate a fourth embodiment of an adjustment device for sports implements, generally indicated by the reference numeral 201, which is constituted by a carriage 204 to which one or more aligned wheels 202 are pivoted and which can slide within a frame 210.

In this embodiment, the means for adjusting the mutual position of the carriage and of the frame are constituted by a screw 216 which is arranged perpendicularly to the carriage and to the frame in a region comprised between two adjacent wheels 202.

Said screw 216 has a head 207 on which a notch is defined; said head protrudes inside the carriage 204 and thus arranges itself in the interspace between two adjacent wheels.

The screw has a threaded stem 217 which interacts with a complementarily threaded bush 225 which is associated with the base of the carriage 204; said threaded stem has, at its free end, a disk 226 which is rotatably associated within a complementarily shaped seat defined on the base of the frame 210 which faces the corresponding base of the carriage 204.

This solution allows to simultaneously vary the position of a pair of wheels.

Figure 9:
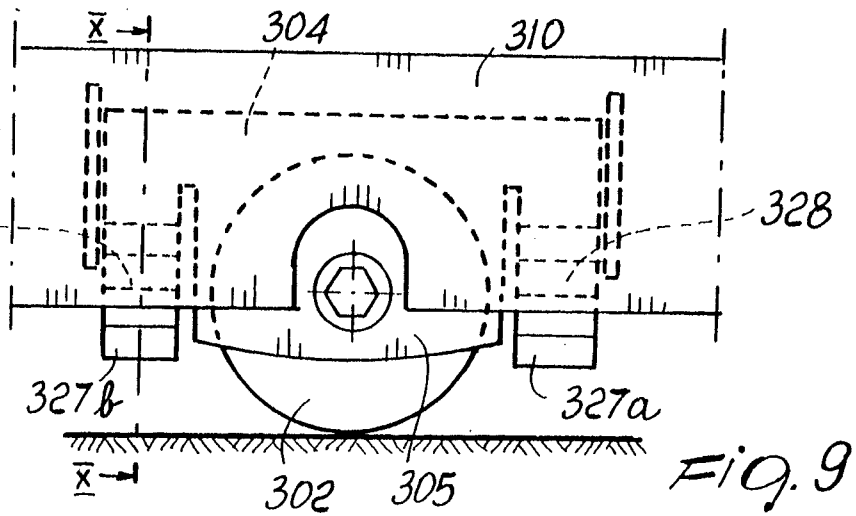
FIG. 9 is a partially sectional side view of a sixth embodiment of the skate.
Figure 10:
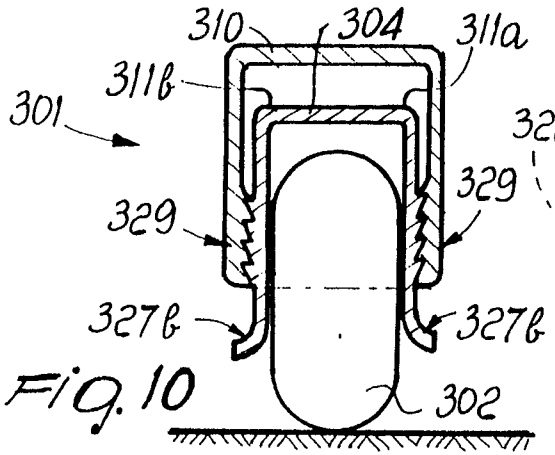
FIG. 10 is a view, similar to that of FIG. 3, of a seventh embodiment.

FIGS. 9 and 10 illustrate a fifth embodiment of an adjustment device for sports implements, generally indicated by the reference numeral 301, which is constituted by a carriage 304, to which one or more aligned wheels 302 are pivoted, which is slidingly associated within a frame 310.

In this embodiment, the means for adjusting and/or guiding the mutual position of the carriage and the frame are constituted by two pairs of tabs 327*a* and 327*b* which are resilient and protrude laterally and below the carriage in the regions adjacent to one or more of the aligned wheels 302 and thus protrude approximately parallel to the first wings 305.

Said two pairs of tabs have a toothed region 328*a* and 328*b* which interacts with a complementarily shaped set of teeth 329 defined on the second wings 311*a* and 311*b* of the frame 310.

The ends of the two pairs of tabs 327*a* and 327*b* protrude below the corresponding ends of the second wings 311*a* and 311*b* of the frame 310, so that they can be gripped by the user so as to momentarily disengage, by virtue of their deformability, the toothed regions of the complementarily shaped set of teeth and thus achieve the adjustment of the mutual position of the carriage and the frame.

Figure 11:
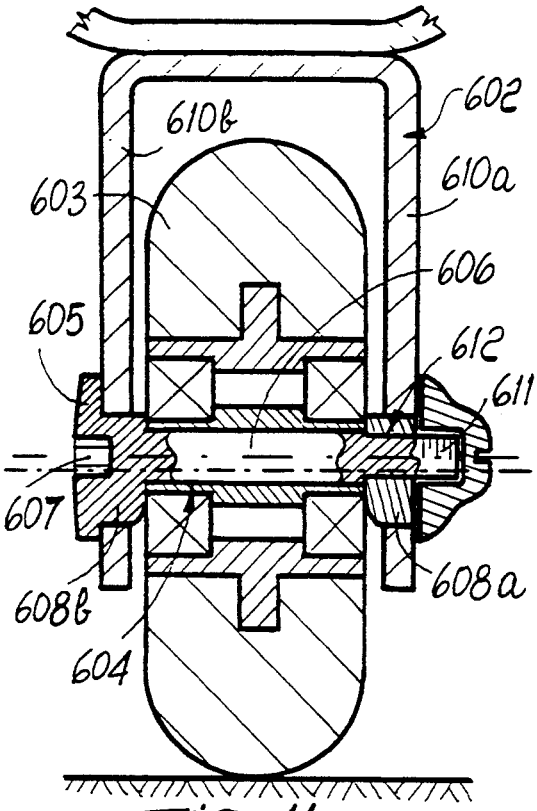
FIG. 11 is a cross sectional partial view of a wheel of a skate according to a further aspect of the invention, in the position of minimum distance between the sole of the item of footwear and the axle of the wheel.
Figure 12:
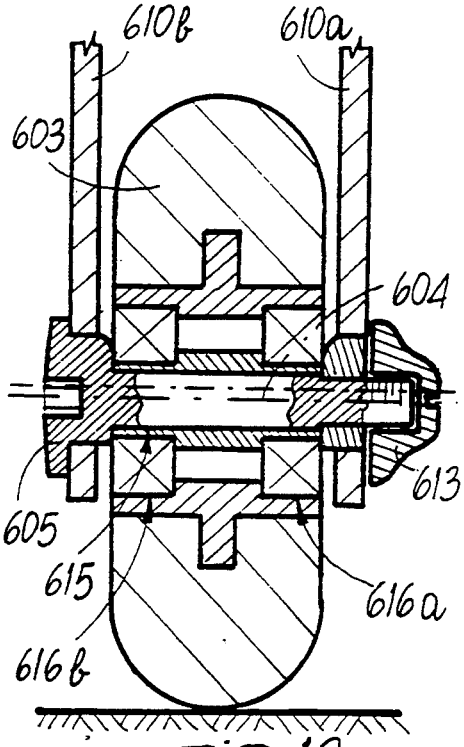
FIG. 12 is a view similar to the preceding one, in the position of maximum distance between the sole and the axle.
Figure 13:
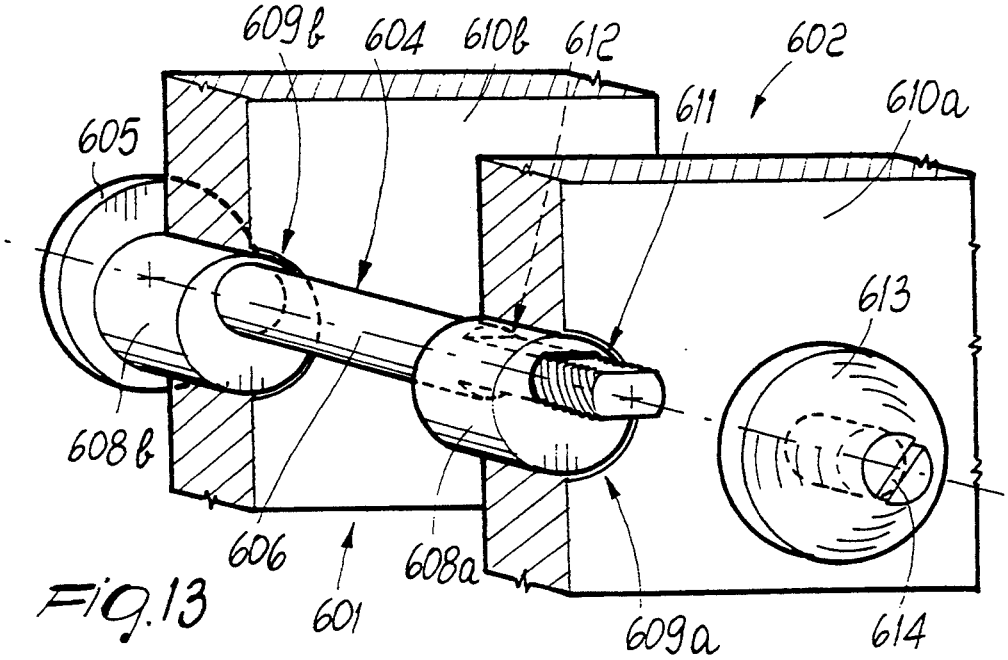
FIG. 13 is a partial perspective view of the skate of FIGS. 11–12.

With reference to FIGS. 11–13, the adjustment device, indicated by the numeral 601, for sports implements, is particularly usable for a skate which comprises a frame 602 for at least two wheels 603 which are arranged mutually aligned.

The adjustment device 601 is applied at one or more of the wheels 603 and is constituted by a single pivot 604 which has a head 605 and a stem 606.

At the head 605 there are means for rotating it constituted for example by a seat 607 with a polygonal configuration for the insertion of an appropriate wrench of the Allen type, or the head 605 itself has the shape of a knob.

A pair of eccentric elements, indicated by the numerals 608*a* and 608*b*, is instead associated with the stem 606 of the pivot 604; said eccentric elements are arranged in complementarily shaped seats 609*a* and 609*b* which are defined on the lateral walls 610*a* and 610*b* of said frame 602.

Said pair of eccentric elements is interposed between the head 605, which is located outside the lateral wall 610*b*, and the threaded free end 611, which is external to the wall 610*a*, of the stem 606.

Advantageously, the eccentric element 608*a* is keyed at a flattened region 612 defined on the stem 606.

A nut 613 is furthermore associable with the end 611 of the stem 606 and has a notch 614 for the tip of a screwdriver; the width of the base of the nut is such as to interact with the eccentric element 608*a* and with the lateral wall 610*a* regardless of the position of said eccentric element: this allows to preset the play between the various components so as to allow an optimum rotation of the pivot 604.

The use of the adjustment device is in fact as follows: the user, by turning the head 605 by using a simple Allen wrench, which has modest dimensions and is thus easy to carry, or by directly turning the hob-shaped head 605, imposes a rotation which arranges the eccentric elements either in the condition illustrated in FIG. 11 or in the condition illustrated in FIG. 12.

It is thus possible to preset the distance between the base of the item of footwear and the axle 604 of the wheel 603 according to the use of the skate.

The closure distance between the lateral walls 610*a* and 610*b* of the frame 602 and the distance between the eccentric elements 608*a* and 608*b* furthermore remains preset and constant, allowing the wheel to rotate without interferences due to friction; this is achieved by virtue of the abutment arrangement which occurs between the eccentric element 608*a* and the stem 606 and between the free end 611 and the cavity of the nut 613.

Finally, the fact is stressed that the eccentric elements 608*a* and 608*b* form abutment shoulders to lock the inner ring 615 for the coupling of the bearings 616*a* and 616*b* to the axle 604 of the wheel 603.

The fact is also stressed that a rotation of the eccentric element through ±90° with respect to the position of FIG. 11 and FIG. 12 allows to vary the longitudinal center distance between two adjacent wheels.

Figure 14:
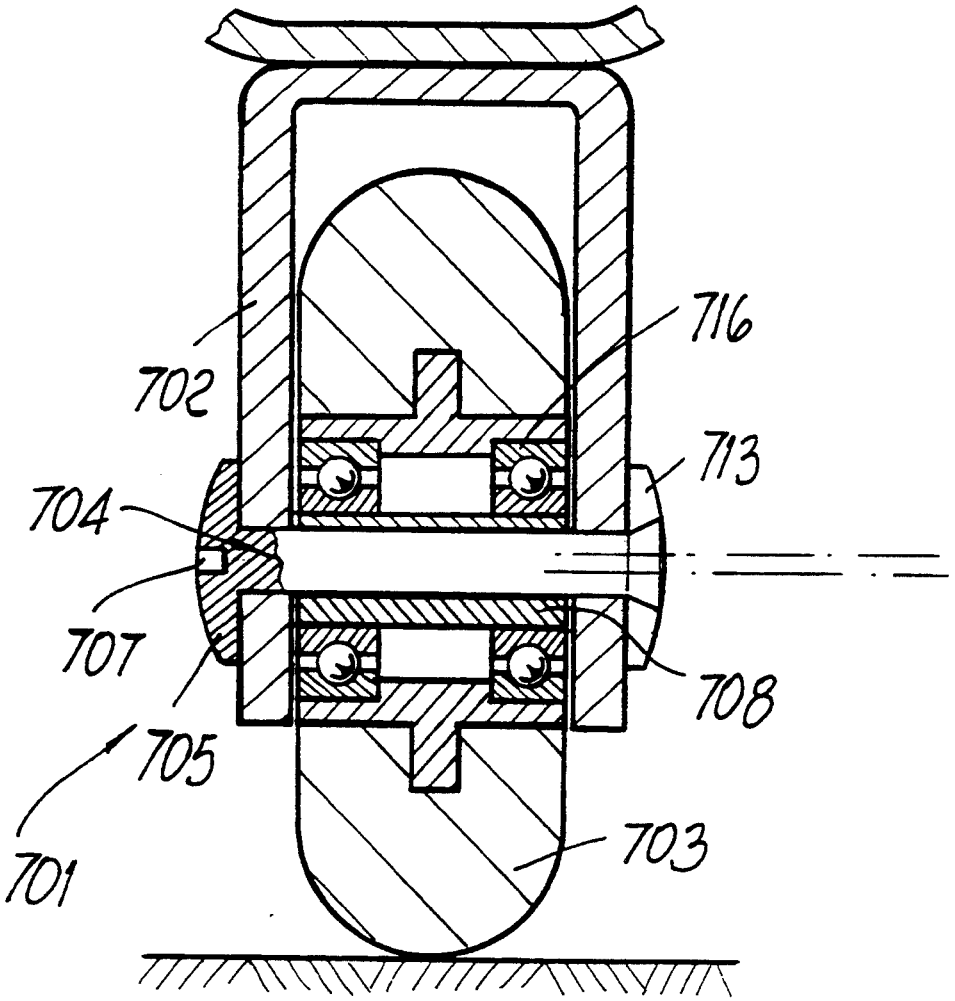
FIG. 14 is a cross sectional partial view of a wheel of a skate according to still a further aspect of the invention.

FIG. 14 shows an adjustment device 701, similar to that of FIGS. 11–13, wherein it comprises a frame 702 supporting at least two wheels of which just wheel 703 is shown.

A shaft, or pivot, 704 is supported by frame 702 and has, at one end, a head 705 provided with a tool seat 707 for engagement with, for example, a screwdriver.

At the other end the shaft 704 is locked by a locking head 713, which can be advantageously removable in a per se known manner, for disassembling the wheel.

Shaft 704 supports an eccentric bush 708 which in turn supports a bearing 716 for the wheel 703.

It is apparent that the adjustment of the wheel position is simply obtained by turning the head 705 of shaft 704 which in turn rotates the eccentric bush 708.

The adjustment can be performed by the skater while wearing the skates.

It has thus been observed that the invention has achieved the intended aim and objects, a skate with aligned wheels having been provided wherein it is possible to adjust, with a single operation and thus in a rapid and easy manner, the distance between the support of the item of footwear and the axle of one or more of the aligned wheels.

The device furthermore allows to perform these adjustments without having to have particular tools available; said adjustments can furthermore be obtained without requiring the disassembly of any component on the part of the user, so that they are even more rapid and straightforward.

Since no disassembly is required, the user no longer needs to have any spare parts available, since the loss of any component cannot be envisaged.

The device according to the invention is susceptible to numerous modifications and variations, all of which are within the scope of the same inventive concept.

The materials and the dimensions which constitute the individual elements of the invention may naturally be the most pertinent according to the specific requirements.

We claim:

1. Adjustment device for a skate comprising a support for an item of footwear and at least two aligned wheels each having a shaft, wherein adjustment means are provided between said at least two aligned wheels and are suitable for varying the distance between said support and the shaft of said at least two aligned wheels, the adjustment device comprising a carriage, between which at least one of said at least two aligned wheels can be arranged, and a frame, within which said carriage is slidingly associated and with which said item of footwear is externally coupled, at least one resilient member being provided between said carriage and said frame, the adjustment device further comprising a carriage which has a substantially C-shaped configuration and having first wings, said carriage being slidingly associated inside said frame which is C-shaped, said item of footwear being rigidly associated on said frame, said frame having second wings which are arranged parallel to said first wings and are slightly longer than said first wings, first slots being defined longitudinally on said second wings, pivot means for fastening said wheels at said carriage wings being able to slide freely at said first slots.

2. Device according to claim 1, wherein means for guiding the mutual position of said carriage and of said frame are arranged at said second wings of said frame, said means being constituted by a pair of pivots which protrude laterally outside said first wings of said carriage, said pivots sliding within adapted second slots defined longitudinally to said second wings, resilient pads being interposed at said pivots at said second slots.

3. A skate comprising:

a support frame;

a carriage; means for slidably supporting said carriage on said support frame such that said carriage is positionable in a plurality of stable positions along a substantially vertical direction of the support frame;

at least two wheels;

means for rotatably supporting said at least two wheels on said carriage;

thereby upon positioning of said carriage with respect to said support frame the at least two wheels both assume a relative position with respect to said support frame.

4. The skate of claim 3, wherein said carriage comprises a raised portion with an inclined plane which is inclined with respect to a horizontal plane of the support frame, the skate further comprising: a threaded screw which is rotatably supported by said support frame; and a slider element through which said threaded screw is screwed so that said slider is slidable in a direction parallel to the horizontal plane of the support frame, the slider element also comprising an inclined plane which is in sliding contact with said inclined plane of the raised portion of the carriage.

5. The skate of claim 4, further comprising biasing means for biasing said carriage in a vertical direction.

6. The skate of claim 4, wherein said support frame is C-shaped with a pair of wings between which said carriage is arranged, said carriage also comprising a pair of wings which extend substantially parallel to the wings of said support frame and between which said at least two wheels are rotatably supported, the carriage further comprising a pair of pivots which extend into a pair of vertical slots provided in the wings of said support frame, a pair of resilient members being arranged in said vertical slots and surrounding said pivots.

7. The skate of claim 4, wherein said support frame is C-shaped with a pair of wings between which said carriage is arranged, said carriage also comprising a pair of wings which extend substantially parallel to the wings of said support frame and between which said at least two wheels are rotatably supported, the skate further comprising a leaf spring having ends which are connected to the wings of said support frame and a middle portion connected to said raised portion of the carriage.

8. The skate of claim 4, further comprising a pair of springs which extend in a vertical direction and which are interconnected between said support frame and said carriage.

* * * * *